United States Patent [19]

Ramari

[11] 4,225,871

[45] Sep. 30, 1980

[54] COLLAPSIBLE, FLATTENABLE AND DRUM WRAPPABLE TYPE OF RADIO ANTENNA, PARTICULARLY FOR MOTOR-VEHICLES AND MOVING EQUIPMENTS

[76] Inventor: Luigi Ramari, Piazza Bottini,, 1-Milan, Italy

[21] Appl. No.: 916,510

[22] Filed: Jun. 19, 1978

[51] Int. Cl.[2] ..... H01Q 1/14; H01Q 1/32

[52] U.S. Cl. ..... 343/877; 343/903

[58] Field of Search ..... 343/877, 901, 903, 880, 343/900; 52/113, 121

[56] References Cited

U.S. PATENT DOCUMENTS

| | | | |
|---|---|---|---|
| 2,157,278 | 5/1939 | Blackmore | 343/877 |
| 2,276,935 | 3/1942 | Como | 343/877 |
| 2,834,012 | 5/1958 | Allen | 343/877 |
| 3,331,075 | 7/1967 | Moulton | 343/877 |
| 3,541,568 | 11/1970 | Lowenhar | 343/900 |

FOREIGN PATENT DOCUMENTS

| | | | |
|---|---|---|---|
| 787048 | 11/1957 | United Kingdom | 343/903 |

*Primary Examiner*—Eli Lieberman

*Attorney, Agent, or Firm*—Mawhinney & Connors

[57] ABSTRACT

An antenna has a housing at least one opening with a drum rotatably mounted in said housing perpendicular to the opening and a wave receiving stylus carried by the drum for projection from the housing through said opening. The stylus is a band preformed according to a given curved shape about its longitudinal axis with the band being sufficiently resilient so as to be flattened and wound up on the drum and being sufficiently flexible so as to assume a tubular configuration in cross-section in the absence of stress when in a position extended from the housing. Idler rollers are carried by the housing around the drum in spaced relation thereto to limit band sliding frictions with respect to the housing and guide elements are interposed between the idler rollers to promote a correct superimposition of the band spirals on and off the drum.

15 Claims, 12 Drawing Figures

FIG.1
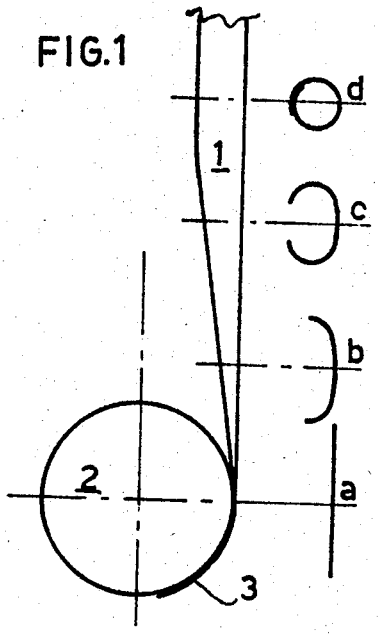
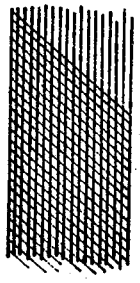
FIG.4
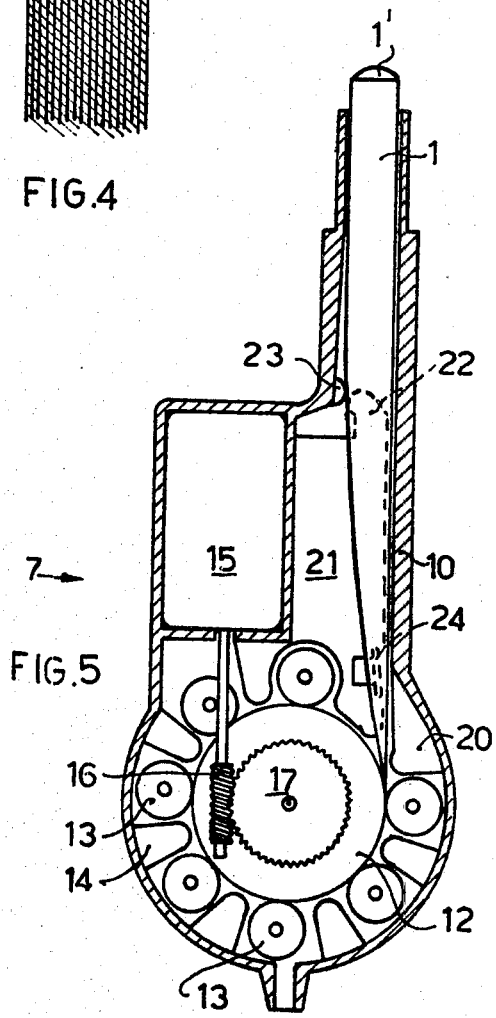
FIG.5
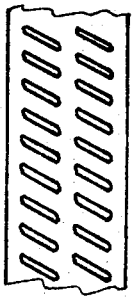
FIG.3A
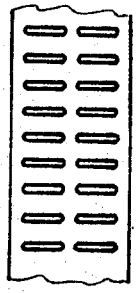
FIG.3B
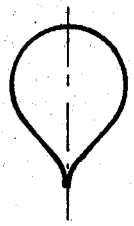
FIG.2A
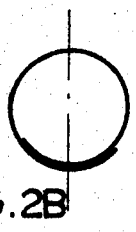
FIG.2B
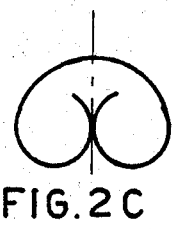
FIG.2C
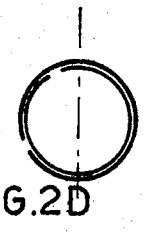
FIG.2D

COLLAPSIBLE, FLATTENABLE AND DRUM WRAPPABLE TYPE OF RADIO ANTENNA, PARTICULARLY FOR MOTOR-VEHICLES AND MOVING EQUIPMENTS

BACKGROUND AND OBJECTS OF THE INVENTION

The present invention relates to the field of receiving antennas, having a collapsible type of receiving stylus or stem or element, such as those used in many applications, for example for radio or TV sets, but particularly for use with radio sets on motor-vehicles.

As is well known, listening to a receiving radio set or receiver on a motor-vehicle involves the use of an efficient receiving antenna applied to the outside of the motor-vehicle.

At present, the most commonly used collapsible radio atennas are those of telescopically collapsible type of stylus, that is comprising a plurality of tubular sections of different diameter, so as to enter one another. Where electrical antennas are concerned, the various stylus sections are forced to move out in order to extend the antenna (or vice versa to re-enter for shortening thereof) by an inner nylon core which can be wound up or unwound from a drum, the latter being generally controlled by an electric motor. In some particular cases, band antennas of planar or slightly curved section have been also used, but such antennas have been scarcely used due to excessive flexibility in longitudinal directions.

It is the object of the present application to provide an antenna having a collapsible type of radio wave receiving element or stylus, the manufacture of which is by far less expensive than conventional antennas, while exhibiting all the advantages of the latter as to antenna operation and reception, and which is also sufficiently rigid to withstand normal operating conditions on a motor-vehicle.

Said objects have been accomplished by a type of antenna, wherein the stylus comprises a steel band or made of other material having characteristics of elasticity and flexibility, which band can be extended or retracted in a container body or housing, and taking at its extended or extracted portion a circular or ogive configuration in cross-section, or any configuration for assuring stability and strength thereof, while taking at its retracted portion a flattened straight configuration for winding up on a roller or drum.

Particularly, said band is during its preliminary manufacture stage shaped according to a curved shape along the longitudinal axis, thus causing it to have a tendency to take under normal conditions a tubular appearance with ogival, circular or other configuration in cross-section.

Such particular approximately tubular configurations taken by the subject band when being removed from its associated container body or housing enable the band to have an appropriate rigidity as to bending stresses exerted by wind or acceleration or deceleration movements or vibration of the motor-vehicle.

It is also an object of the present invention to provide an antenna of further improved type, comprising means for promoting a shape change in cross-section for the band forming the antenna stylus. The antenna also comprises means for limiting the friction between the body or housing and wound up stylus. Additionally, the improved antenna according to the present invention may be also made with a double band stylus in order to improve the strength thereof. Finally, the antenna band may be also preshaped according to a plurality of shapes.

Rather than in steel, an antenna band according to the invention can be made of other metals or alloys, or plastic materials or appropriate type of combined plastic materials and metals.

As above stated, the antenna according to the present invention is less expensive than conventional antennas, and at a same level of performances, it is less liable to jammings. The present antenna provides the additional advantages of a highly reduced maintenance, less possibilities of failures and improved electrical contact, since the stylus is an integral unit or element and the frictions increased by the sliding strain between the various tubes for antennas of telescopic type of stylus are removed.

BRIEF DESCRIPTION OF THE DRAWINGS

Further features and advantages of the antenna according to the present invention will become apparent from the embodiments hereinafter shown with reference to the accompanying drawings, in which:

FIG. 1 is a schematic side view taken along a semi-wrapped band antenna stylus to show at a, b, c, and d how the cross-section thereof progressively varies;

FIGS. 2A, 2B, 2C and 2D are cross-sectional views across various embodiments of the antenna, showing configurations that could be provided therefor;

FIGS. 3A and 3B are views showing antenna band sections or lengths as suitably provided with cutouts or slots;

FIG. 4 is a view showing an antenna band section or length made from a metal braid;

FIG. 5 is a schematic, partly sectional view showing an embodiment of a powered antenna unit according to the present application;

DETAILED DESCRIPTION OF THE INVENTION

Figure 6:
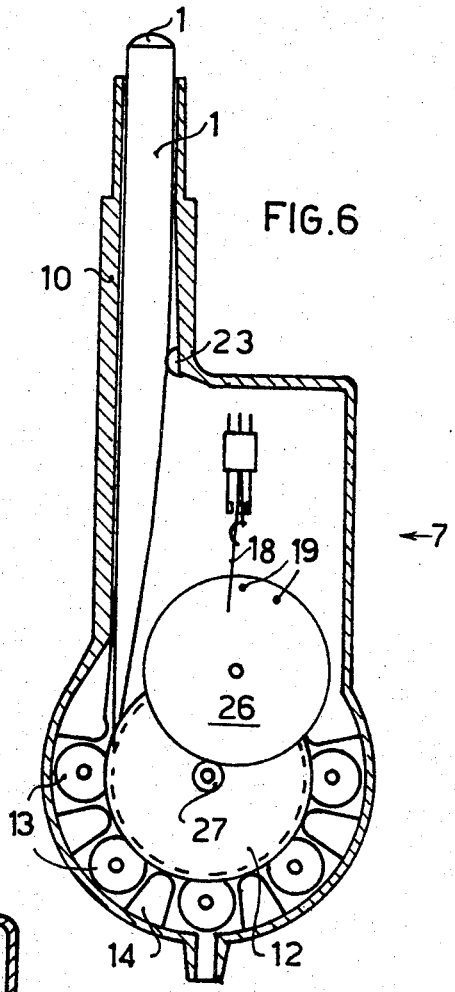
FIG. 6 is a view as seen from the opposite side to that of FIG. 2.

Referring to FIG. 1, there is shown a stylus 1, or antenna receiving element, which is partly wound up on a roller or drum 2 and partly unwound therefrom.

An antenna according to the present invention comprises a band stylus 1, preshaped with a wound up or partially wound up configuration along the longitudinal axis thereof, the band stylus being of a quite conductive material to allow an efficient reception, sufficiently flexible for winding up on a roller or drum with axis substantially perpendicular to the longitudinal axis of the antenna, and sufficiently resilient to recover its original wound up configuration (the cross-section being of circular, ogival or the like shape) even after a long period of rolling or winding in a substantially flat arrangement of said roller or drum.

A band edge (such as 3) is secured to the roller in any known way, whereas the opposite edge is left in a free condition and may have a plug applied (designated at 1' in the following figures of the drawings) for protecting the end thereof.

The band section or length wound up on the roller is in cross-section of a flattened configuration, as in (a) of FIG. 1, so that several layers of the antenna band can be superimposed on roller 2 in a comparatively reduced thickness.

As the band is unwound from the roller, as shown at b, c and d, it will gradually take due to its own elasticity a C-shaped configuration having its ends increasingly close to each other until taking the final O-shaped configuration, preferably with partly superimposed sides, as beforehand imparted thereto, and such that the antenna is given some bending strength in longitudinal direction. On band rewinding on drum 2, the band section or length should open to an increasingly wider C, until taking the flat transverse configuration shown at (a).

Hitherto, reference has been made to an antenna band which was preformed according to a circular section, having a longitudinal edge or rim partially superimposed, as shown also in 2B. However, the antenna could be preformed with other shapes in cross-section, for example a nearly ogival shape, as shown in FIG. 2A, a double circle shape jointed as in FIG. 2C, or with any other shape for giving thereto some rigidity sufficient for holding the antenna at extended or raised state under normal conditions as encountered when a motor-vehicle is running.

The antenna stylus could also comprise a plurality of superimposed bands, preferably having a cross-section of nearly C-closed shape, as shown in FIG. 2D, the C openings being preferably offset to one another.

A material which at present is believed to be particularly suitable to form the band antennas according to the application is a steel band from thin gauge sheet, particular care being devoted to the fiber direction, and in the case subjected to heat treatment. Particularly, should the fibers be arranged in perpendicular direction or skew relative to the longitudinal band direction, a higher fatigue limit to band deflection would result, thus allowing a larger amount of the section flattenings in the windings on and unwindings from the drum, and a closer winding of the band will be permitted along its longitudinal axis, while being still below the yielding point of the material.

Band winding on the drum can be also facilitated, but without adversely affecting the rigidity thereof when at extracted position, by providing the band with spaced apart cutouts or slots, preferably having an elongated configuration according to the fiber direction, or transversely of the longitudinal axis of the band. This, for example, can be seen in FIGS. 3A and 3B, respectively showing a band section or length having skew cutouts or slots; and a band section or length with cutouts or slots elongated in a direction orthogonal to the longitudinal axis of the band. In both cases, such cutouts or slots would allow an improved winding on the drum. Both of these bands are preferably coated with one or more layers of plastic material.

Another embodiment for the antenna stylus or stem may comprise a braid or weave of metal wire (FIG. 4) with high elasticity characteristics, being in cross-section of a similar shape to that of the above described metal bands, and in the case covered with plastic material.

Finally, the antenna band could be made of any plastic material incorporating a conductor, but having high elasticity characteristics.

Referring to FIGS. 5, 6, 7 and 8, some preferred embodiments of the antenna body or housing are shown.

Figure 7:
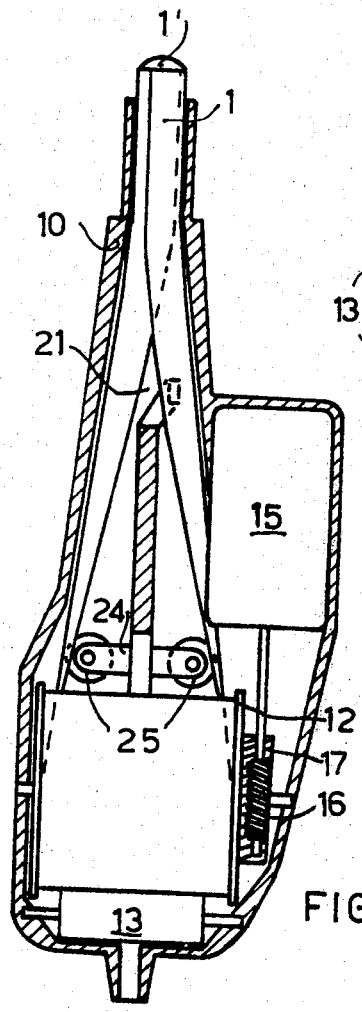
FIG. 7 is a view taken in the direction of arrow 7 in FIGS. 5 or 6 with a portion of the housing or shell that has been removed.

In the embodiment shown in FIGS. 5, 6 and 7, body or housing 10 internally carries a drum 12 for winding up the antenna band 1 and a series of idle rollers 13, which are arranged with the axes parallel to the axis of drum 12 and on a circumference coaxial with said axis of drum 12. Rollers 13 define a space for the band wound up portion and the band turn, which at any time is the outermost turn, is arranged thereagainst. Between each two consecutive rollers 13 a fixed element or portion 14 is arranged and integral or fixed to said housing or body, having its inner surface slightly retracted relative to the circular inner surface tangential to rollers 13. Of course, various shapes and arrangements are possible for the rollers and fixed parts. Guide elements 20, 21 integral or fixed to said body or housing form a guide for the band at the position at which it passes from flat configuration in cross-section to rolled or wound up configuration in cross-section (and vice versa). Thus, at such a position, the risk exists that the band may be longitudinally deflected, taking undesired positions. Preferably, guide elements 20 and/or 21 are fixed to the body or housing itself and have top parts or beaks 22, 23, the shape and size of which are suitable to one another to promote the correct arrangement of the longitudinal edges of band 1 as the latter is rolled up along its longitudinal axis. Additionally, an opening means 24 is also provided as carried integrally with element 21 and hence with said housing or body, and which in turn carries two idle wheels or rollers 25, engaging said band 1 to facilitate the opening or spreading of the latter when it should be flattened for winding up on drum 12. Of course, more than one opening means 24 can be provided.

By the above disclosed ingenuities, the friction on unwinding or rewinding is remarkably reduced. The exemplary embodiment shown in FIGS. 5, 6 and 7 is completed by the schematic representation of members controlling the rotation of drum 12, and particularly a motor 15, driven by the vehicle dashboard, and controlling a worm screw 16, meshing with a gear wheel 17 integral or fast with drum 12. By way of example (FIG. 6), the electrical connections comprise a tongue switch 18 changing position by touching detents or stops 19 carried by an externally toothed disc 26 meshing by a high reduction ratio with a pinion 27 which is integral or fast with the drum. Such an approach allows to shut off the current supply to motor 15 at the positions of totally extracted or re-entered antenna. In order to switch off said motor when the antenna stylus is completely extracted or re-entered, other known electrical approaches or friction approaches between said gear wheel 26 and drum 12 could be used.

Figure 8:
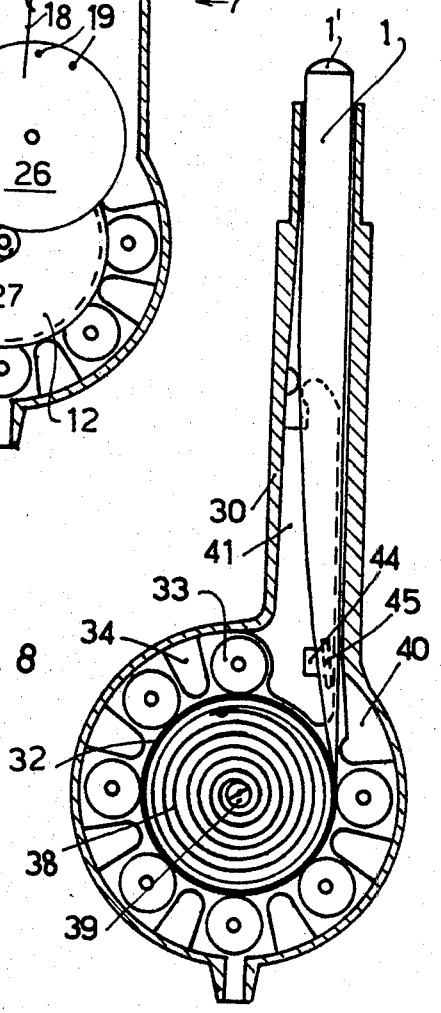
FIG. 8 is a schematic,, partly sectional view showing an antenna embodiment similar to that of FIG. 1, but which is manually controlled.

Referring to FIG. 8, there is shown an embodiment for the antenna similar to that of FIG. 2, but with the band which can be manually extracted. In this case, a body or housing 30 for band stylus 1 has a winding drum 32 therein, which is restrained to a fixed axis 38 by a spiral spring 38. As said band 1, carrying at the top a plug 1', tends to be resiliently unwound, that is to cause said drum to rotate in counterclockwise direction as seen in FIG. 8 the spring presses the drum in opposite direction, that is in the band winding direction, and is precisely calculated, so that the drum is substantially balanced at any position of the antenna band. Also in this case, an array of idle rollers 33 and fixed parts 34 surround the wound up portion of the antenna, so as to limit or reduce the friction upon winding and unwinding. Guide elements 40 and 41, similar to guide elements 20 and 21 of the preceding embodiment, are for guiding the band unwinding, and a roller means 44, 45 is provided for the same function as means 24, 25 described in connection with the preceding embodiment.

The guide elements 20, 40 are considered outer guide elements since they guide the exterior portion of the antenna. Similarly, guide elements 21, 41 are considered inner guide elements since they guide the interior portion of the antenna.

Further changes and modifications can be made to the foregoing description, but it should be believed that all such changes and modifications within the common capability of those skilled in the art would pertain to the scope of the present invention.

What I claim is:

1. A collapsible stylus type of radio antenna comprising a housing having an opening, a drum rotatably mounted in the housing for rotation about an axis perpendicular to the opening, a receiver stylus coiled in the housing for projection therefrom through the opening into an elongated form, said stylus comprising a band preformed around its longitudinal axis according to a curved shape so as to assume a substantially tubular configuration in cross-section in the absence of stress when in a position extended from the housing, said band being sufficiently resilient so as to be opened into a flat state and wound in such state on the drum, a fixed element provided internally of the housing adjacent the opening therein over which the band passes and which prevents bowing of the band at such position, a plurality of idler rollers freely rotatably mounted in the housing on axes parallel to the axis of rotation of the drum and arranged in a circle around and spaced radially from the drum a sufficient distance to accommodate said band and for limiting band sliding frictions with respect to the housing, fixed surfaces interposed between the idler rollers to promote a correct superimposition of the band spirals on and off the drum, and a series of idler rollers carried by the housing at the area of the opening to promote the changing of the band from one shape to another.

2. A collapsible stylus type of antenna comprising a housing having an opening, a drum rotatably mounted in the housing for rotation about an axis orthogonally disposed relative to said opening, a receiver stylus coiled in the housing for projection therefrom through the opening into an elongated form, said stylus comprising a band preformed around its longitudinal axis according to a curved shape so as to assume a substantially tubular configuration in cross-section in the absence of stress when in a position extended from the housing, said band being sufficiently resilient so as to be opened into a flat state and wound in such state on the drum, a fixed guide element provided internally of the housing adjacent the opening therein over which the band passes and which engages the band to prevent bowing of the band at such position, said fixed guide element including an outer guide element extending from a point adjacent the discharge of said flat band from said drum to said opening and further including an inner guide element extending from adjacent an upper portion of said drum and through a portion of said opening in said housing to guide said flat band into a substantially tubular configuration, means carried by the housing and arranged in spaced relation around the drum for limiting band sliding frictions with respect to the housing and fixed surfaces interposed with said means to promote a correct superimposition of the band spirals on and off the drum, and a series of idler rollers carried by the housing at the area of the opening to promote the changing of the band from one shape to another.

3. An antenna according to claim 1 or 2, wherein said stylus is formed by two superimposed bands.

4. An antenna according to claim 1 or 2, wherein said band is made of sheet material and has the fibers thereof arranged transversely of the longitudinal axis of the antenna stylus.

5. An antenna according to claim 1 or 2, wherein said band is made of sheet material and has the fibers thereof skewly arranged relative to the longitudinal axis of the antenna stylus.

6. An antenna according to claim 1 or 2, wherein said band is made of sheet material and along the length thereof an array of cutouts are provided to weaken the cross-sections of the band so as to enable the band to be wound more easily on the drum.

7. An antenna according to claim 1 or 2, wherein said band is composed of a plurality of interweaved metal wires.

8. An antenna according to claim 1 or 2, wherein the band is coated with plastic material.

9. An antenna according to claim 1 or 2, wherein the band is made of plastic material incorporating a conducting material.

10. An antenna according to claim 1 or 2, the antenna being of manual operation type, wherein the drum is restrained to a fixed portion of the body or housing by a spiral spring, secured at one end to said fixed portion and at the other end to said drum, said spring being calculated to balance the resilient band tendency to unwinding.

11. An antenna according to claim 1 or 2, wherein the antenna is power operated.

12. The invention of claim 2 wherein said means includes a plurality of idler rollers freely rotatably mounted in the housing on axes parallel to the axis of rotation of the drum and arranged in a circle around and spaced radially from the drum a sufficient distance to accommodate said band.

13. The invention of claim 12 wherein said fixed surfaces being interposed between the idler rollers.

14. A collapsible stylus type of antenna according to claim 2, wherein said inner guide element including a beak portion mounted at the upper end thereof adjacent to a point where the band is transformed into a substantially tubular configuration and a corresponding beak element disposed adjacent thereto on an inner surface of said opening for guiding the outer surface of said antenna.

15. A collapsible stylus type of antenna according to claim 2, wherein said drum is driven by an electric motor and a limit switch is provided to terminate the electric motor when the antenna is in its fully extended or retracted positions.

* * * * *